US007721696B2

(12) United States Patent
Evans et al.

(10) Patent No.: US 7,721,696 B2
(45) Date of Patent: May 25, 2010

(54) CAM FOLLOWER FOR A VALVE DRIVE OF AN INTERNAL COMBUSTION ENGINE

(75) Inventors: Matthew Evans, Warren, MI (US); Debora Manther, Royal Oak, MI (US); Donald Haefner, Troy, MI (US); Richard Best, Garden City, MI (US)

(73) Assignee: Schaeffler KG, Herzogenaurach (DE)

( * ) Notice: Subject to any disclaimer, the term of this patent is extended or adjusted under 35 U.S.C. 154(b) by 476 days.

(21) Appl. No.: 11/881,368

(22) Filed: Jul. 26, 2007

(65) Prior Publication Data

US 2008/0022954 A1 Jan. 31, 2008

Related U.S. Application Data

(60) Provisional application No. 60/833,673, filed on Jul. 27, 2006.

(51) Int. Cl.
*F01L 1/18* (2006.01)

(52) U.S. Cl. ..... 123/90.44; 123/90.31; 123/90.48; 74/569

(58) Field of Classification Search ..... 123/90.16, 123/90.27, 90.31, 90.48, 90.5, 90.52, 90.55, 123/90.39, 90.44
See application file for complete search history.

(56) References Cited

U.S. PATENT DOCUMENTS 7,341,034 B2 * 3/2008 Fujii et al. ..... 123/90.48

* cited by examiner

*Primary Examiner*—Ching Chang
(74) *Attorney, Agent, or Firm*—Charles A. Muserlian

(57) ABSTRACT

Proposed is a cam follower (1) for a valve drive of an internal combustion engine, having a roller (3), which is rotatably mounted on a journal (2), as a cam thrust face, which journal (2) runs with its outer casing (4) in a respective bore (5, 6) of a first and second guide wall (7, 8) of the cam follower (1), between which guide walls (7, 8) the roller (3) is held, which outer casing (4) is composed of a first and a second section (9, 10), which first section (9) intrinsically has a greater diameter than the second section (10), wherein the journal (2) has an axial travel limitation in one direction by means of its collar (11) which is situated between the sections (9, 10), and in the other direction by means of a radially projecting element such as a securing ring (12), which collar (11) and which securing ring (12) abut against one of the guide walls (7, 8).

7 Claims, 1 Drawing Sheet

CAM FOLLOWER FOR A VALVE DRIVE OF AN INTERNAL COMBUSTION ENGINE

This application is a non-provisional application of provisional application Ser. No. 60/833,673 filed Jul. 27, 2006.

FIELD OF THE INVENTION

The invention relates to a cam follower for a valve drive of an internal combustion engine, having a roller, which is rotatably mounted on a journal, as a cam thrust face, which journal runs with its outer casing in a respective bore of a first and second guide wall of the cam follower, between which guide walls the roller is held, wherein the journal is held in the bores by means of travel limitations.

BACKGROUND OF THE INVENTION

A cam follower of said type can be gathered from U.S. Pat. No. 5,385,124 which is considered as generic. The journal is secured axially by means of two securing rings which run in annular grooves of bores in the guide walls. The formation of the two annular grooves for the securing rings is complex. It is also observed that the assembly of the journal, with the snapping-in of the two securing rings, is unnecessarily complex.

GB 2 233 418 A (FIG. 2) discloses a cam follower whose journal is calked at both ends. Said calked connection can become loosened during operation, for example in the event of unfavorable tolerancing. It is otherwise clear that undesired influencing of the bore region of the respective guide wall can occur as a result of the material displacement which has taken place during the calking. In addition, calking of said type requires increased checking expenditure at the quality control stage.

OBJECT OF THE INVENTION

It is therefore an object of the invention to create a cam follower of the above-described type, in which the stated disadvantages are eliminated.

ACHIEVEMENT OF THE OBJECT

According to the invention, said object is achieved by means of the novel features of claim 1, with expedient physical embodiments of the invention being the subject matter of the subclaims, which can also contain individually patentable measures.

Accordingly, in simple terms, an axial travel limitation of the journal is provided in only one direction by means of a securing ring which is provided at the end side on the outer casing of said journal, whereas an axial travel limitation in the other direction of said journal is formed by means of an annular collar which runs between two stepped diameter regions of the journal.

Here, it is particularly expedient if, as is proposed in a physical embodiment of the invention, the journal is guided with a clearance fit with respect to the bores and with slight axial play between the travel limitations.

A "floating" bearing arrangement of the journal in relation to the bores is therefore provided. By means of the collar, there is a "hard" abutment of the journal against a lateral surface of one of the guide walls. Another abutment can be formed by means of a corresponding inner annular face of the proposed securing ring. It is therefore clear to a person skilled in the art that the journal fixing according to the proposed invention permits a small axial travel and also a rotational movement of the journal relative to the bores. The stepped-diameter journal can be mass-produced easily in manufacturing terms.

It is also possible, instead of the proposed securing ring, to provide further separate elements, such as for example split pins or other radially projecting components.

In a refinement of the invention, it is proposed to guide the roller on the journal either by means of a rolling bearing arrangement which is known per se, or to provide a plain bearing in this region.

Considered as a cam follower is for example a beam-like component, such as a tilt lever, oscillating arm or rocker arm, or else a roller tappet. All components can be present in switchable or non-switchable form, and can likewise be designed such that they can be acted on only indirectly in the valve drive.

BRIEF DESCRIPTION OF THE DRAWINGS

The invention is explained in more detail on the basis of the drawing.

DETAILED DESCRIPTION OF THE DRAWINGS

Figure 1:
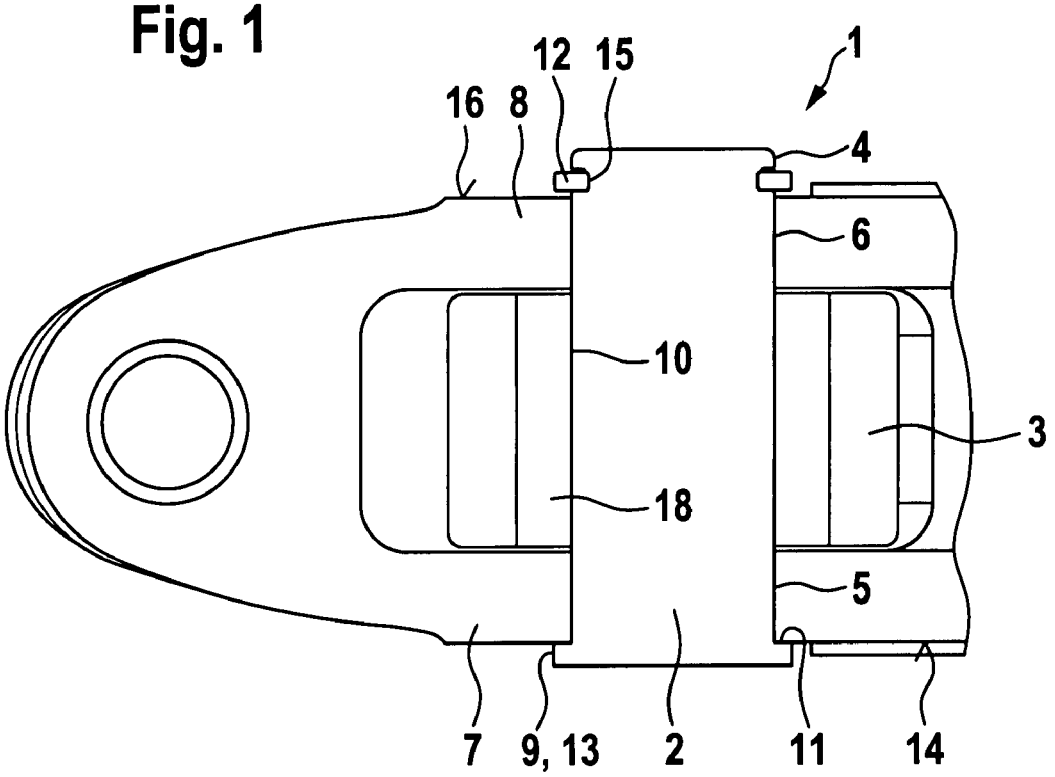
FIG. 1 shows a schematic plan view of a beam-like cam follower having a first variant of a fastening of its journal.

FIG. 1 shows a plan view of a cam follower 1 which is embodied as a rocker arm or oscillating arm, wherein the bearing region of said cam follower 1 is not illustrated here for clarity.

That end of the cam follower 1 which is illustrated at the left-hand side acts, by means of its underside, on a gas exchange valve. Here, the cam follower 1 has two opposing guide walls 7, 8, in the cutout of which is held a roller 3 as a direct cam thrust face. The roller 3 runs, in FIGS. 1, 2, on a journal 2 via a rolling bearing 18 such as a needle bearing arrangement.

The journal 2 is designed with stepped thickness, and is composed of a first section 9 and a second section 10, wherein the first section 9 has a greater diameter than the second section 10. As can be seen, the first section 9 is illustrated in FIG. 1 as an annular projection 13. The latter bears against an outer lateral surface 14 of the first guide wall 7.

The two bores 5, 6 in the guide walls 7, 8 (FIG. 1) have an identical diameter. Axially behind the second guide wall 8, a securing ring/circlip 12 runs in an annular groove 15. An axial travel limitation of the journal 2 in its other direction is therefore provided by means of contact of said securing ring 12 against an outer lateral surface 16 of the second guide wall 8. As illustrated, the journal 12 is guided in the bores 5, 6 with slight axial play (see spacing of the securing ring 12 to the outer lateral surface 16 of the second guide wall 8). In addition, the journal 2 is held so as to be rotationally moveable relative to the bores 5, 6, so that, for both solutions, it is possible to refer to a "floating" bearing arrangement.

Figure 2:
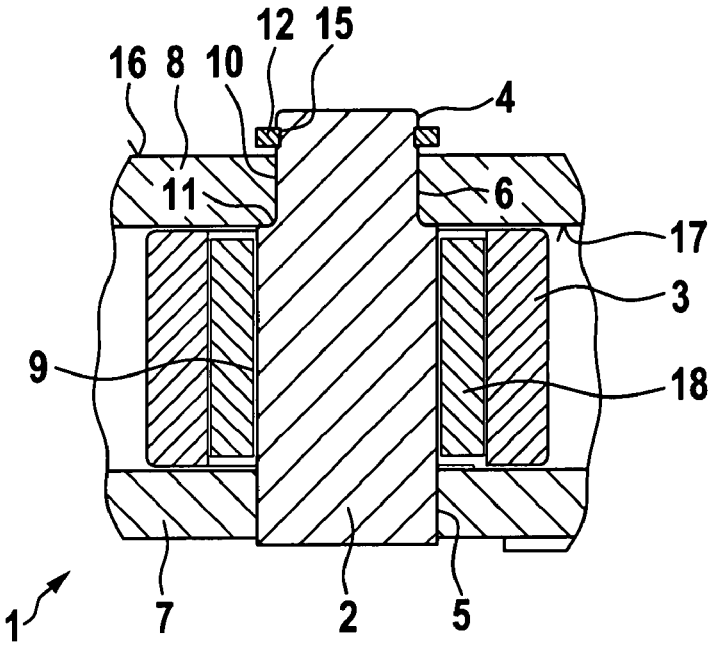
FIG. 2 shows an alternative variant to FIG. 1.

FIG. 2 shows a similar embodiment to FIG. 1. However, the bores 5, 6 in the guide walls 7, 8 have a different diameter. Here, the first bore 5 is larger than the second bore 6. The journal 2 extends with its first section 9 through the bore 5, and, by means of the collar 11, faces an inner lateral surface 17 of the second guide wall 8. The second section 10 of the journal 2, with a smaller diameter, runs in the second bore 6. The design of the securing ring 12 is the same as in FIG. 1.

LIST OF REFERENCE SYMBOLS

1 Cam follower
2 Journal
3 Roller
4 Outer casing
5 First bore
6 Second bore
7 First guide wall
8 Second guide wall
9 First section
10 Second section
11 Collar
12 Securing ring
13 Projection
14 Outer lateral surface
15 Annular groove
16 Outer lateral surface
17 Inner lateral surface
18 Rolling bearing

The invention claimed is:

1. A cam follower for a valve drive of an internal combustion engine, having a roller, which is rotatably mounted on a journal runs with an outer casing in a respective bore of a first and second guide wall of the cam follower, the roller is held between the first and the second guide walls, wherein the outer casing is composed of a first and a second section, wherein the first section intrinsically has a greater diameter than the second section, wherein the journal has an axial travel limitation in one direction by means of a collar which is situated between the first and second sections, and in the other direction by means of a radially projecting element as a securing ring, wherein the collar and the securing ring abut against one of the guide walls.

2. A cam follower of claim 1, wherein the journal is guided with a clearance fit with respect to the bores and with slight axial play between the axial travel limitations.

3. A cam follower of claim 1, wherein the first section of the journal is formed as a ring-shaped projection whose collar faces an outer lateral surface of the first guide wall, wherein the two bores have an identical diameter, and the journal extends with its second section, which supports the roller, through the two bores, and wherein the securing ring runs in an annular groove on the journal at an outer lateral surface of the second guide wall.

4. A cam follower of claim 1, wherein the first section of the journal extends through the bore of the first guide wall, and, with the collar, faces an inner lateral surface of the second guide wall and supports the roller, wherein the second section runs through the bore of the second guide wall, which bore has a correspondingly smaller diameter than the bore correspondingly smaller diameter than the bore of the first guide wall, and wherein the securing ring is arranged in an annular groove on the journal at an outer lateral surface of the second guide wall.

5. A cam follower of claim 1, wherein a bulk article as a circlip or a half-moon-shaped clip is used as a securing ring.

6. A cam follower of claim 1, wherein the roller runs on the journal by means of a rolling bearing, as a full-roller or cage-guided needle bearing arrangement, or by means of a plain bearing.

7. A cam follower of claim 1, wherein the cam follower is embodied, so as to be switchable or non-switchable, either as a beam component as a tilt lever, oscillating arm or rocker arm, or as a rolling tappet or bucket tappet, wherein in the case of an embodiment as a beam-like component, the guide walls are embodied as side walls, and in the case of an embodiment as a rolling tappet, the guide walls are formed as lug extensions, which are suspended from a housing at a cam side, or as a constituent part of the housing.

* * * * *